US007001664B2

(12) United States Patent
Travelute et al.

(10) Patent No.: US 7,001,664 B2
(45) Date of Patent: Feb. 21, 2006

(54) METHOD AND APPARATUS FOR HIGH DENIER HOLLOW SPIRAL FIBER

(75) Inventors: Frederick L. Travelute, Charlotte, NC (US); Evan T. Basalik, Gastonia, NC (US)

(73) Assignee: Wellman, Inc., SC (US)

( * ) Notice: Subject to any disclaimer, the term of this patent is extended or adjusted under 35 U.S.C. 154(b) by 47 days.

(21) Appl. No.: 10/951,018

(22) Filed: Sep. 27, 2004

(65) Prior Publication Data

US 2005/0037196 A1 Feb. 17, 2005

Related U.S. Application Data

(62) Division of application No. 10/364,891, filed on Feb. 13, 2003, now Pat. No. 6,797,209, which is a division of application No. 09/851,569, filed on May 8, 2001, now Pat. No. 6,746,230.

(51) Int. Cl.
*D01F 6/00* (2006.01)

(52) U.S. Cl. ..... 428/376; 428/398; 428/395

(58) Field of Classification Search ..... 428/376, 428/398, 395

See application file for complete search history.

(56) References Cited

U.S. PATENT DOCUMENTS

| | | | |
|---|---|---|---|
| 2,999,296 | A | 9/1961 | Breen et al. |
| 3,313,000 | A | 4/1967 | Hays |
| 3,323,168 | A | 6/1967 | Van Drunen et al. |
| 3,387,327 | A | 6/1968 | Privott, Jr. et al. |
| 3,405,424 | A | 10/1968 | Imobersteg et al. |
| 3,600,491 | A | 8/1971 | Shimoda et al. |
| 3,635,641 | A | 1/1972 | Turner |
| 3,745,061 | A | 7/1973 | Chempaneria et al. |
| 3,772,137 | A | 11/1973 | Tollivar |
| 3,920,876 | A | 11/1975 | Albert et al. |
| 3,924,988 | A | 12/1975 | Hodge |
| 3,938,925 | A | 2/1976 | Lees |
| 4,056,597 | A | 11/1977 | Cooper |
| 4,408,977 | A | 10/1983 | Phillips |
| 4,444,710 | A | 4/1984 | Most, Jr. |
| 4,548,866 | A | 10/1985 | Cordova et al. |
| 4,551,378 | A | 11/1985 | Carey, Jr. |
| 4,631,162 | A | 12/1986 | Yoshimoto et al. |
| 4,791,026 | A | 12/1988 | Yoshimoto et al. |
| 5,330,348 | A | 7/1994 | Aneja et al. |
| 5,356,582 | A | 10/1994 | Aneja et al. |
| 5,407,625 | A | 4/1995 | Travelute et al. |
| 5,458,971 | A | 10/1995 | Hernandez et al. |
| 5,510,183 | A | 4/1996 | Travelute et al. |

(Continued)

FOREIGN PATENT DOCUMENTS

| | | | |
|---|---|---|---|
| RU | 724608 | A | 3/1980 |

*Primary Examiner*—N. Edwards
(74) *Attorney, Agent, or Firm*—Summa & Allan, P.A.

(57) ABSTRACT

An apparatus and method for producing self-texturing hollow fiber that exhibits a desirable tendency to coil rather than to bend sharply or zig-zag. In one embodiment the invention is a spinneret for the production of hollow filament having first and second curved slots where each slot is defined by a first end having a first width and a second end having a second width and where the first and second ends are separated by an intermediate portion possessing a non-uniform width. In another embodiment the invention is a method for of producing generally cylindrical hollow filaments comprising extruding a polymer melt through a spinneret having first and second curved slots where each slot has a first end having a first width and a second end having a second width and where the first and second ends are separated by a intermediate portion possessing a non-uniform width along the continuum defined by the distance between the first end and the second end.

14 Claims, 2 Drawing Sheets

U.S. PATENT DOCUMENTS 5,531,951 A 7/1996 Travelute et al.
5,585,182 A 12/1996 Aneja et al.
5,593,629 A 1/1997 Travelute et al.
5,601,918 A 2/1997 Travelute et al.
5,614,296 A 3/1997 Travelute et al.
5,643,600 A * 7/1997 Mathur ..... 424/450
5,723,215 A 3/1998 Hernandez et al.
5,997,980 A 12/1999 Matoba et al.

* cited by examiner

METHOD AND APPARATUS FOR HIGH DENIER HOLLOW SPIRAL FIBER

RELATED APPLICATIONS

This application is a divisional application of application Ser. No. 10/364,891 filed Feb. 12, 2003 now U.S. Pat. No. 6,797,209, which is a divisional of Ser. No. 09/851,569 filed May 8, 2001, and now U.S. Pat. No. 6,746,230.

BACKGROUND

The invention relates to an apparatus and method for producing filaments from a thermoplastic polymer, and in particular relates to a self-texturing filament formed from polyester that exhibits a desirable tendency to form helical coils when properly drawn and finished rather than remain straight and without texture. The apparatus and method are particularly well suited for forming spiraled high denier hollow filaments from recycled materials.

Synthetic polymers are used in many textile applications to replace natural textile materials such as wool and cotton. Synthetic polymers are also used for other textile-related applications such as insulation layers in clothing, particularly clothing for outdoor use in colder weather, and for bulking properties in pillows and other such products in which these properties are alternatively provided by natural materials such as feathers or by synthetic foam materials.

The starting product for almost all synthetic textile material is a liquid polymer. The liquid polymer is extruded through a device called a "spinneret" containing at least one and typically many small orifices. Extruding the liquid polymer in this fashion creates extended solid cylindrical filaments. Such filaments have some immediate uses such as fishing line. In textile applications, however, synthetic filaments and the fibers and yarns made from them should desirably provide properties similar to those of natural fibers such as wool or cotton. In order to provide such properties, synthetic filaments must be modified or textured before being formed into yarns and fabrics. As is well understood in the textile industry, texturing can comprise crimping, looping, or otherwise modifying continuous filaments to increase their cover, resilience, abrasion resistance, warmth, insulation properties, and moisture absorption, or to provide a somewhat different surface texture. Filaments are also structurally modified to impart desired physical properties. For example, hollow filaments of cylindrical and triangular cross-sections or possessing bulbous appendages are known in the art.

Typical texturing methods include false twist texturing, mechanical texturing such as edge crimping or gear crimping, air jet crimping, knit-de-knit crinkles, or core-bulked filaments. Each of these has its own particular properties, advantages, and disadvantages.

Among these various types of textured filaments, coils are preferred for certain applications such as cushions and insulation. Coiled filaments tend to give more volume and fewer sharp bends, "zig-zags," or "knees." Generally speaking, coiled filaments take on a coil or spiral configuration that is somewhat more three dimensional than other textured filaments and thus are preferred for many bulking applications, including those mentioned above. Hollow coiled filaments are particularly useful in bulking applications.

Typical methods for coiling filaments include false twisting or edge crimping, both of which techniques are well-known to those of ordinary skill in the art, and will not be otherwise further described herein. Both of these methods have various advantages and disadvantages in producing coiled yarns. For example, false twist coiling requires a conventional false twist winding system, while an edge crimp method requires the mechanical devices necessary to physically produce the crimp.

Alternatively, coiled filaments can be formed from bilateral fibers that coil following further processing. Traditionally, bilateral fibers are formed from two different generic fibers or variants of the same generic fiber extruded in a side-by-side relationship. Although side-by-side or "bicomponent" spinning offers certain advantages, it also is a relatively demanding process that requires more complex spinning equipment and thus is advantageously avoided where unnecessary.

In the early and mid-1990's, apparatus and methods for forming hollow self-texturizing filaments were developed that avoided the problems associated with the above-mentioned texturing methods. These apparatus and methods utilized, among other things, a unique quenching method that coiled the filament without mechanical manipulation of the filament. U.S. Pat. Nos. 5,407,625; 5,510,183; and 5,531,951 (commonly assigned to the present assignee) are representative of this step forward in textile technology.

In the past few years, a combination of the public's increasing awareness of the finite nature of natural resources, the desire to reduce pollution and improved recycling technology has greatly expanded the market for recycled materials. Accordingly, manufacturers continue to search for new and better methods for incorporating recycled materials into their production processes. The polymer industry is particularly active in this area.

Many companies currently use recycled polymers (i.e., polyester) to manufacture various goods including filament. Nevertheless, the use of recycled polyester—the majority of which is from post-consumer beverage bottles—as feedstock for filament production poses numerous problems. One problem associated with recycled feedstock (as opposed to virgin polymer) is the variation in the viscosity (which directly reflects the molecular weight) of the feedstock. Another problem is the presence of unwanted contaminants. Both of these problems disturb the flow of the melt through the spinneret, which in turn leads to disruptions in the subsequent processing of the filament of which the most troublesome are line breakages.

The above problems may be reduced or eliminated by (1) improving the quality of recycled feedstock, or (2) adjusting the production process. By its very nature, the quality of feedstock is often governed by factors outside of the control of the recycler. Accordingly, adjustment of the production process for a wide variety of feedstocks often offers the most promising long term means to address these problems.

One typical adjustment is to use filtration to remove a portion of the contaminants from the recycle. Filter life depends upon the filter fineness (i.e., grade) and the percentage of contaminants removed. Long filter life is desired to avoid process interruptions therefore coarser filters are often used. Coarser filters allow more contaminants to pass through. Accordingly, additional contaminant related adjustments, such as the use of larger spinneret holes (which allow passage of larger contaminant particles) are often necessary. Another typical adjustment is to use a spinneret with fewer orifices at the same throughput thereby producing larger denier filament (i.e. 6–15 dpf). The larger denier can be achieved via slower take-up speeds and higher throughput per hole. The larger orifices also provide more area for passage of solid contaminants. Changing size, of course, can limit certain end uses for the filaments.

Processes upstream and downstream of the spinneret, however, are typically fixed for a specific volume of product. For example, the quantity of polymers fed to the spinneret and the take-up speed of the filament (i.e., the speed at which the filament is taken up on rollers) are usually fixed or are only minimally variable. Thus, a combination of fixed volume and larger orifice translates to slower velocities through the spinneret (i.e., slower extrusion speeds). For regular filament the ratio of take-up speed (or process speed) to extrusion speed is typically on the order of 120:1. This ratio is often called the stretch ratio because the change in velocity physically stretches the filament.

$$\text{stretch ratio}=\text{process speed}\div\text{extrusion speed}$$

For large denier hollow-fiber filament, which has a slower extrusion speed, the stretch ratio is typically around 300–400:1.

The high stretch ratio for production of large denier hollow-fiber filament causes problems in the production of spiral filaments. The spiral effect is achieved through use of a rapid one-sided quench as described in the previously listed and commonly assigned patents. The rapid quench combined with a slow extrusion speed and high stretch ratio increases the maximum value of the melt's strain rate as the filament is formed in the quench zone. The maximum strain rate, also called the "maximum dv/dx," is the maximum value of the ratio $$\frac{dv}{dx}=\frac{\text{increase in fiber speed in the process direction}}{\text{incremental distance in the process direction}}$$

This ratio only applies where the fiber is still molten in the quenching zone and increasing in velocity from the extrusion velocity to the take up velocity. If the maximum strain rate is exceeded the filament breaks which interrupts production.

In other words, because the filament solidifies shortly after leaving the spinneret the filament must rapidly accelerate from the slow extrusion speed to the fast take-up speed. This rapid acceleration places a large amount of strain on the filament. If the strain rate is higher than the polymer relaxation time, the filament will likely break. Slower cooling (i.e., slower quench) can moderate this problem, but a faster differential cooling is needed to spiral the filament as noted in the commonly assigned patents.

In short, current production methods for large denier hollow fiber are hindered by opposing but unavoidable production components: rapid quenching and high stretch ratios. Therefore, a need exists for an apparatus and method for producing self-texturing hollow fiber filament from recycled material and particularly higher-denier filament from recycled material that avoids the difficulties associated with current production practices.

OBJECT AND SUMMARY OF THE INVENTION

Accordingly, an object of the present invention is to develop an apparatus and method for forming hollow fiber that avoids the problems associated with current production techniques. In particular, an object of the present invention is to develop an apparatus and method for forming hollow fiber from recycled material that avoids the production problems associated with extruding feed material defined by varying viscosity and solid contaminants.

The invention meets this object with a spinneret for the production of hollow filament comprising first and second non-linear (e.g. curved slots). A first end having a first width and a second end having a second, different width define in part each slot. An intermediate portion defined in part by a graduating width along its length separates the first and second ends of each slot.

In another aspect, the invention is a method of producing hollow filaments comprising extruding a polymer melt through a spinneret where the spinneret comprises first and second non-linear (e.g., curved slots) where each slot has a first end having a first width and a second end having a second, different width. Each slot is further defined as having a graduating width along the continuum defined by the distance between the first and second ends of each slot.

Alternatively, the invention may be described as an extrusion characterized by a velocity gradient along the length of the openings through which polymer melt is extruded. For ease of discussion, the invention is discussed in the context of hollow cylindrical filaments which are a commonly produced hollow filament. Those skilled in the art, however, will readily recognize that the concepts of the invention, particularly extruding polymer melts having a graduated width, are equally applicable to non-cylindrical hollow filaments.

DETAILED DESCRIPTION

The present invention is a method and apparatus for producing self-texturing filaments that exhibit a desirable tendency to extrude perpendicular to the die face rather than interfere with adjacent filaments.

In one broad embodiment, the invention is a spinneret for the production of hollow filament comprising first and second non-linear slots, orifices or openings. In preferred embodiments, the non-linear slots are curved or arcuate, although slots incorporating fixed angles are also encompassed by the term non-linear. Each slot possesses a first end having a first width and a second end having a second width that is different from the first width and an intermediate portion between the two ends. The intermediate portion is defined in part by a non-uniform or variable width that graduates from the width of said first end to the width of said second end.

In another broad embodiment, the invention is a method of producing generally cylindrical hollow filaments. The method comprises extruding a polymer melt through the above described spinneret followed by directing a quenching fluid at one side of the hollow filaments to thereby produce filaments with different orientations on each side. Alternatively, the method may be broadly described as an extrusion in which the velocity of the melt through the above described slots changes along the continuum defined by the distance between first and second ends of the slots.

As used herein, the term "orientation" refers to the degree to which the chain molecules of a polymer are parallel to one another and to the longitudinal dimension of a filament. The degree of orientation can be measured using techniques well known in this art, particularly including birefringence. This detailed description of the invention begins with a discussion of the apparatus embodiments of the invention.

In general terms, the invention comprises extruding a liquid polymer through a spinneret comprising two non-linear slots. In preferred embodiments, the slots are C-shaped thereby forming two C-shaped polymer sections that are merged shortly after they are extruded to form a hollow filament. In preferred embodiments, the liquid polymer comprises polyester.

It will be understood by those familiar with the extrusion of filaments with various cross-sections that the phrase C-shaped is a general way of designating two shapes which when brought together would have a hollow space in between, including shapes that would very much resemble the letter "C." It will be further understood that the term C-shaped is utilized herein as an aid to reader in visualizing the invention and is not to be interpreted as limiting the scope of the invention.

Figure 1:
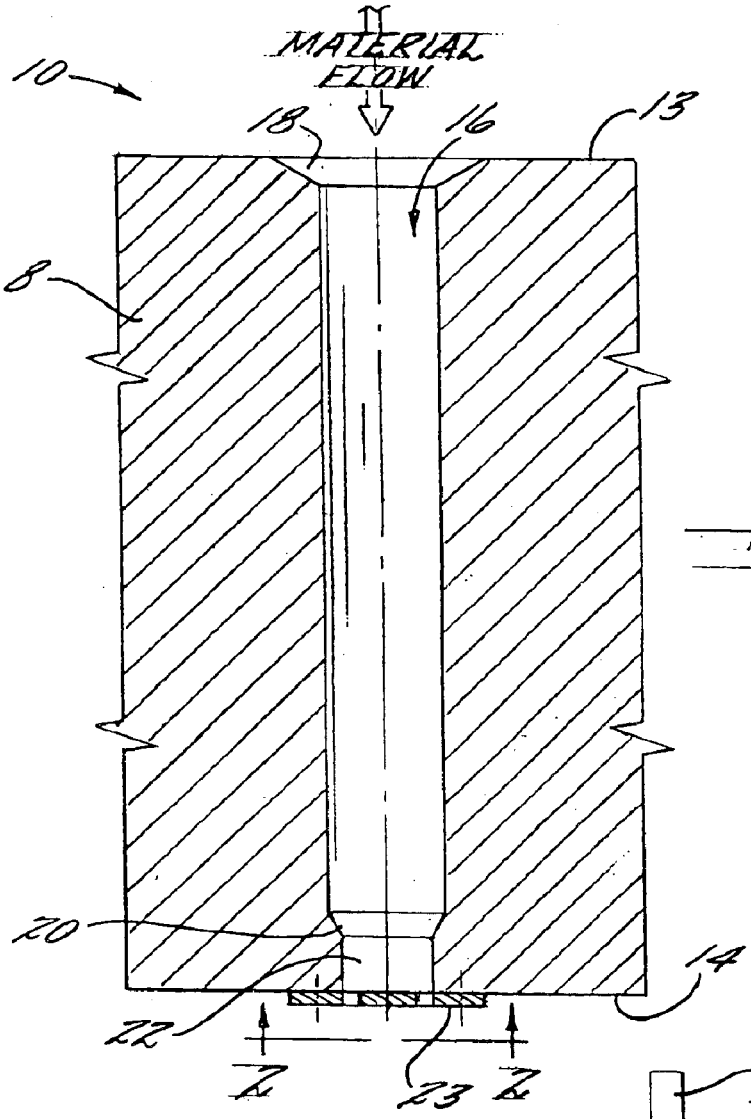
FIG. 1 is a cross-sectional view of one embodiment of the apparatus according to the invention.

Referring now to FIG. 1, a cross-section of a spinneret 10, including the path of material flow (i.e., liquid polymers) through the spinneret, is shown. The spinneret 10 may be thought of as a plate 8 having a first face 12 and a second face 14 and an opening 16 extending through the plate 8 from the first face 12 to the second face 14. In preferred embodiments the opening 16 is cylindrical The opening 16 is further defined in preferred embodiments by a converging angled portion 18 at the entrance of opening 16 that aids the flow of liquid polymer into and through the opening 16. The opening 16 terminates in a second converging angled portion 20 that focuses the flow of material into a nozzle 22 proximate the second face 14. The nozzle 22 comprises a barrier 23 that may be integrated with the second face 14 or may be a separate plate attached to the second face. The embodiment shown in FIG. 1 utilizes a separate plate. Those skilled in the art recognize that the term "spinneret" as used in the industry also may encompass other elements, such as feed lines, filters, etc., that are not specifically described herein. Such elements are conventionally known and their application to the present invention may be accomplished without undue experimentation.

Figure 2:
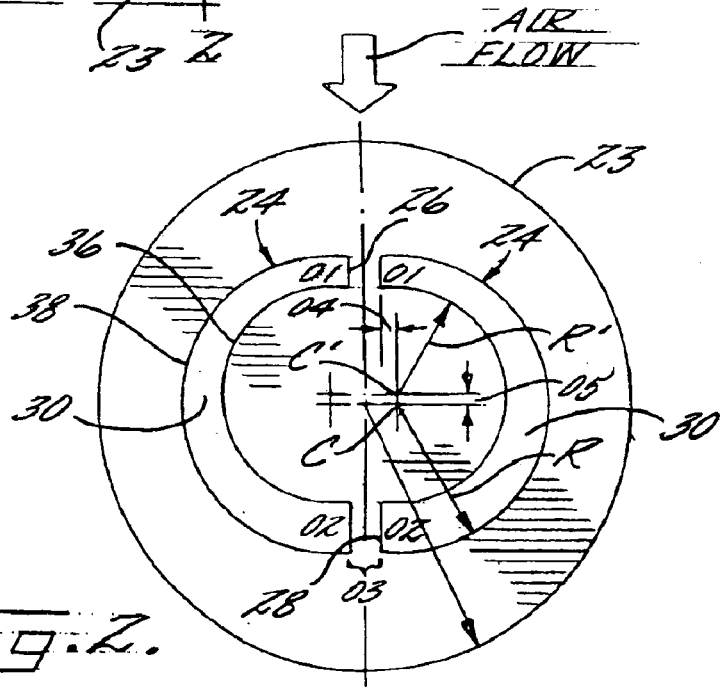
FIG. 2 is a view showing representative openings in a spinneret.

Referring now to FIG. 2, taken along the line 2—2 shown in FIG. 1, the nozzle 22 comprises a barrier 23 having two non-linear orifices. In preferred embodiments, the orifices are curved or arcuate slots 24. As shown in FIG. 2, the curved slots 24 may be thought of as C-shaped or horseshoe shaped. Each slot 24 possesses a first end 26 and a second end 28. The first end 26 of the slot 24 has a first width D1 and the second end of the slot 28 has a second width D2 where the first width D1 is different from the second width D2. In the embodiment shown in FIG. 2 the first width D1 is smaller than the width D2. The slot 24 is further defined by a non-uniform or graduated width along the intermediate portion, broadly designated at 30, separating the first and second ends 26, 28. The embodiment of the slot 24 shown in FIG. 2 incorporates a gradually increasing width in a direction going from the first end 26 to the second end 28. The intermediate portion may also be characterized in that no two points along the length of the intermediate portion share the same width. Although FIG. 2 illustrates a barrier 23 containing one pair of curved slots 24, the apparatus according to the invention encompasses a barrier 23 having a plurality of such paired slots that mate with a plurality of nozzles 22.

The general curved orientation of the slots 24 shown in FIG. 2 is typical of hollow fiber production, but the slots of the invention are unique in several respects. The curved slots 24 are separated by a distance D3 and generally form the shape of a bisected cylinder. The distance between the curved slots 24 may vary depending upon the particular needs of the manufacturer but is generally on the order of 0.05 to 0.2 mm. A preferred arrangement of the curved slots 24 places the first ends 26 of the two slots directly opposed to one another and the second ends 28 likewise situated. Thus, the "thin" ends of the slots face one another and the "thick" ends of the slots face one another. This is the arrangement shown in FIG. 2. The relative terms "thin" and "thick" are used herein as an aid to the reader and should not be interpreted as limiting the scope of the invention.

In a further preferred embodiment, the first and second ends 26, 28 of each slot 24 terminate such that the first and second ends are substantially parallel to each other as shown in FIG. 2. Additionally, the opposing pairs of first ends 26 and the pair of second ends 28 preferably are parallel to one another as shown in FIG. 2. The parallel portions of the first and second ends 26, 28 may be extended as represented by the distance D4 in FIG. 2. The distance D4 may vary depending upon the circumstances and the requirements of the filament. For example, traditional hollow filament spinnerets using semi-circular slots tend to produce distorted filaments upon quenching. Most often such distorted filaments exhibit a slightly oval shape where the elongated axis of the oval runs through the joints where the two semi-circular segments fuse. Extending the parallel portions of the first and second ends can compensate for any unwanted distortion caused by quenching.

In a further alternative, the apparatus according to the invention may be described as a spinneret for the production of hollow filament comprising first and second non-linear slots. In preferred embodiments the slots 24 are curved or arcuate with each slot possessing a first end 26 having a first width D1 and a second end 28 having a second width D2 as described above. The spinneret also comprises a first (or inner) wall 36 connecting the first end 26 and the second end 28 of the slot 24. The first wall 36 is defined in part by a first radius R extending from a first point C: the point C being interior to the arc formed by the arcuate slot 24. A second (or outer) wall 38 connects the first end 26 and the second end 28 of the slot 24. The second wall 38 is defined in part by a second radius R' extending from a second point C': the point C' being interior to the arc formed by the arcuate slot 24. C and C' are separated by a distance D5 as shown in FIG. 2. This geometric orientation creates a slot 24 having a varying width along its length. The remaining physical geometric and functional aspects of this embodiment are similar to those set forth above.

Those skilled in the art will recognize that the dimensions of the slots and the precise geometry of the spinneret will vary depending upon the size and shape of the desired filament. Accordingly, the dimensions set forth below are exemplary and should not be interpreted as limiting the scope of the invention. In preferred embodiments, the invention is utilized to form larger spun denier filaments (e.g., greater than 5) but may also be used for smaller denier filaments. The Applicants envision that in most applications D1 will vary between 0.1 mm and 0.3 mm. D2 will necessarily vary between values greater than 0.1 mm and 0.3 mm. Likewise, the distance separating the slots 24, D3, may vary depending upon the circumstances but should be close enough for a liquid polymer flowing through the slots to join prior to quenching. In preferred embodiments, the distance D3 will be between 0.05 mm and 0.3 mm.

R will vary depending upon the distance D5 separating the center points C and C' which may vary depending upon cross-section desired for the filament. In most applications, this distance D5 will be between 0.01 mm and 0.03 mm. R will typically vary between about 0.3 mm and about 0.6 mm. Likewise, R' may vary depending upon the distance D5. Although R' may vary, its value is typically set by setting the values for D5, D1 and R or D1, D2 and R (e.g., R'=R+D2−D5; R'=R+D5+D1). Finally, the length of the parallel portions of the slot or opening, represented schematically as D4, may theoretically be any value but will preferably be of a distance sufficient to compensate for any unwanted distortion of the filament caused by quenching. In preferred embodiments, the distance represented by D4 will be between 0.05 mm and 0.15 mm.

The invention also encompasses a method of producing hollow filaments through extrusion. The physical act of extruding is carried out in a manner well known to those in the art. The unique dynamics of the method according to the invention, however, aid in overcoming the problems associated with known extrusion methods as outlined in the Background section.

The method according to the invention may be described purely in dynamic and functional terms. For example, one embodiment of the method comprises extruding polymer melt to form a generally arcuate or C-shaped section of a polymer melt. This embodiment further comprises extruding the polymer melt under conditions to create a velocity gradient along an arc defining the greater portion of the arcuate section. Stated alternatively, the extrusion is characterized by a graduated velocity continuum along the length of the generally C-shaped portion. The method also comprises extruding a second C-shaped portion where the two portions are arranged such that the concave sides of the C-shaped portions are directly opposed to one another. Fusing two such arcuate or C-shaped sections forms a cylindrical hollow filament. After fusing, the filaments may be subjected to typical post-fusion operations (i.e., quenching). These operations are discussed in more detail below.

The dynamic and functional aspects of the method according to the invention also may be described in more mechanical terms. Accordingly, the method may be described as extruding a polymer melt through a spinneret such that the velocity of the melt extruded through an opening in the spinneret changes along the continuum defined by the distance between one end of the opening and the other end of the opening. Such an opening is illustrated in FIG. 2 by an arcuate slot 24 having a first end 26 and a second end 28 and an intermediate portion broadly represented by the numeral 30. The velocity change of the extruded polymer melt is created in part by the slots 24 having a first width D1 at the first end 26 and a larger second width D2 at the second end 28. In a system such as this the velocity of the melt through the spinneret is directly related to the geometry of the opening, albeit in a somewhat counterintuitive way.

With fluids such as water or air (and assuming sufficient back pressure), if one were to reduce the area of an exit opening (i.e., reduce the size of a nozzle) basic fluid mechanics dictates that for any given volume of fluid and for any given period of time the velocity at which the volume of fluid must travel to traverse a smaller orifice must be greater than the velocity needed to traverse a larger orifice. For systems such as the one contemplated by the present invention, the flow of melt through the spinneret has been observed to behave somewhat differently.

The flow of the melt through the spinneret is believed to be significantly affected by the viscosity of the melt and interactions (such as friction) between the walls of the spinneret orifice and the melt (collectively the "wall effects"). The wall effects combine to create a velocity gradient where the velocity of the melt increases along the continuum going from the first end (or thin end) 26 toward the second end (or thick end) 28. In other words, the polymer melt exits the thick side of the slot faster than the thin side. Although the difference in velocity creates an initial imbalance of extruded material, equilibrium is eventually attained in part through stretching and thinning of the thin side of the melt as the filament fuses and accelerates from the extrusion speed to the take up speed.

The method according to the invention may be defined solely in mechanical terms. Accordingly, the method according to the invention may be described as extruding a polymer melt through a spinneret comprising first and second non-linear openings or slots 24 where each slot has a first end 26 with a first width D1 and a second end 28 with a second width D2 that is different from the first width D1 and a variable intermediate width such as those slots shown in FIG. 2 and discussed previously. The spinneret used in this embodiment of the method also may be described in terms of slots or openings formed by dual centers and dual radii as described above.

In addition to the physical act of extruding a polymer melt through a spinneret such as those described above, the method according to the invention also comprises merging and quenching the two curved sections of extruded polymer melt to form a hollow filament. The basic post-extrusion technology utilized in the formation of the hollow filaments of the present invention generally well-known to those of ordinary skill in the art is set forth in several patents that are commonly assigned with the present invention. Appropriate adjustments can be made on a case-by-case basis, and without undue experimentation. The initial patent in this group of patents is U.S. Pat. No. 5,407,625 to Travelute et al., and the reader is directed to this patent and its progeny for additional information regarding these downstream processes.

The post-extrusion aspects of the method according to the invention comprise merging the extruded curved polymer melts shortly after they are extruded to form a hollow filament. After the polymer melts are merged to form a filament, the filament is quenched to produce solidified hollow filaments. The step of quenching the extruded hollow filament preferably comprises directing a quenching fluid at the extruded hollow liquid polymer predominately from one side of the liquid hollow filaments and close to the point at which the hollow filaments are extruded; preferably within about 4 inches or less of the spinneret and most preferably within about 2 inches.

Although the quenching fluid may be directed at any side of the hollow filament, preferably the fluid is directed at the portion of the filament possessing the most narrow width along the hollow fiber's cylindrical wall. In other words, the quenching fluid is preferably directed perpendicular to the joint formed by the fusion of the two thin ends 26 of the curved polymer sections as shown in FIG. 2. The reduced mass of the thin side of the filament cools rapidly under the influence of the quenching fluid thereby producing a "cool" side and a "hot" side (the thick side). As will be well understood by those of skill in this art, the cold side will at this point be generally more oriented than the hot side. It will be further understood that the terms "cold side" and "hot side" are used for explanatory purposes and not as limitations. In a preferred embodiment the quenching fluid is air.

As is generally the case in filament spinning, the next step is referred to as "take-up" in which the extruded quenched filaments are collected on a series of rollers for further processing or packaging. The filaments solidify under the effects of lowered temperature during the take-up step.

According to the invention, the solidified filaments are then relaxed by heating to a temperature greater than ambient and sufficient for them to relax, but less than the temperature at which they would shrink. Although the inventors do not wish to be bound by any particular theory, the term "relax" as used herein refers to a process in which the frozen-in stresses within the filament are relaxed as a result of the heating process.

Generally speaking, an appropriate temperature range for relaxing polyester filaments is between about 35°–60° C., depending on the extent of relaxation desired, as the intensity of the treatment effect is proportional to the temperature used. The higher temperatures to be avoided are those approaching the glass transition temperature ($T_g$) of polyester, approximately 68° C. In preferred embodiments of the invention, the relaxing step can be accomplished by heating the finishes applied to the filaments. As known to those familiar with this art, in more conventional spinning methods, such finishes are generally added at ambient temperatures.

Following the relaxation step, the hot side of the filament has very little orientation. The cold side has some orientation, but less than it had after the stretching that occurred during the initial take-up step. The differential in orientation between the hot side and the cold side, however, increases following the relaxation step which in turn increases coiling of the filament. As stated earlier, the term "orientation" refers to the degree of parallelism of the chain molecules of a polymer. Although the inventors do not wish to be bound by any particular theory, the relaxation step of the present invention appears to permit both portions of the filament, which have different orientations resulting from the uneven quenching carried out upon them, to relax by the same amount of orientation while they maintain a consistent length (because the halves are fused).

For example (and using numbers chosen to clarify the discussion), a hollow filament or fiber according to the present invention that has one portion with an orientation number of 10 and another portion with an orientation number of 5 has a 2:1 ratio of orientations and will texture accordingly. If that filament is then relaxed by four (4) units, the resulting filament has one portion reduced in orientation from 10 to 6, and a second portion reduced from 5 to 1. The resulting relaxed filament now has an orientation ratio of 6:1 rather than 2:1 and will exhibit correspondingly different properties. It will thus be easily seen that the orientation ratio between the two portions of the same filament has essentially been tripled without any mechanical activity whatsoever.

Those skilled in the art will recognize that the relaxation step is not limited to hollow, round fibers but could be utilized with other shapes where crimping properties could be enhanced by a higher orientation ratio.

The relaxed filament is next drawn in otherwise normal fashion, and then released in the absence of any control on its length. Such drawing has been shown to further increase coiling of the filament. The draw temperature generally approaches the glass transition temperature. The drawing step adds stress to each side of the filament with the more oriented cold side being more stressed than the less oriented hot side. In preferred embodiments using polyester, the filaments are drawn from the natural draw ratio to about 1.1 to about 1.3 times the natural draw ratio.

The drawn filaments are preferably cooled to ambient (i.e., room) temperature, for example by cooling the draw rolls with circulating water. When the filament is released following drawing, both sides tend to return to their earlier condition ("recover"), but the cold side more so than the hot side, and the difference in the degree of recovery creates the desired coils. Preferably, the drawn tension is released very suddenly, and as soon as possible after drawing. Similarly, because the relaxation forces are relatively moderate, interference with the filaments as they coil should preferably be avoided.

As a final step, the coiled filaments can be heat set. The heat setting may occur at approximately the maximum crystallization temperature of the polymer. In a preferred embodiment, the heat set occurs at temperatures of about 177° C. (350° F.) to produce a rigid coiled filament that is about 40% crystallized.

In another aspect, the invention comprises a method of coiling bilateral hollow filaments in which the two component polymers are identical except for their degree of orientation. As known by those skilled in the art, bilateral filaments are usually those formed of two different polymers or two forms of a generic polymer. In the present invention, however, the two component polymers are identical and are only oriented differently as a result of the uneven quenching and non-uniform thickness. The coiling method of the invention comprises raising the temperature of the hollow filaments to a temperature sufficient for the filaments to relax, but less than the temperature at which they would shrink. After a drawing step as described above, the filaments are released to coil in the absence of any control on their length.

In the preferred embodiments, the component polymers comprise polyester, specifically a single polyester, and the step of raising the temperature of the filaments sufficiently for the filaments to relax comprises raising their temperature to between about 35° C. and 60° C., depending upon the extent of relaxation desired.

Thus, in brief summary, the method steps of the invention can comprise extrusion, quenching, take-up, relaxation, drawing, release, and heat-setting.

The polyester filament according to this embodiment of the invention can also be cut into staple fiber which in turn can be formed into polyester yarns using any conventional spinning technique including ring spinning, open end spinning and air jet spinning, with open end and air jet spinning becoming increasingly more preferred for polyester yarns and blended yams that contain polyester.

It will be understood by those familiar with textile terminology that the term "spinning" is used to refer to two different processes. In one sense, the term "spinning" refers to the production of synthetic polymer filaments from a polymer melt. In its older conventional use, the term "spinning" refers to the process of twisting a plurality of individual fibers into yarns. The use of both of these terms is widespread and well-understood in this art, and the particular use will be quickly and easily recognized by those of ordinary skill in the art based upon the context of any such use.

Accordingly, the yams formed from the filaments of the invention can in turn be woven or knitted into fabrics which have the advantageous characteristics referred to herein. Similarly, fibers formed according to the invention can be used to produce non-woven fabrics or used in non-woven applications (e.g., fill).

In yet another embodiment, the invention comprises a coiled bilateral hollow polymeric filament in which the two component polymers are identical except for their degree of orientation. The coiled bilateral filament is further defined by a non-linear wall formed of at least two non-linear sections. In preferred embodiments the coiled bilateral filament is further defined by a cylindrical wall formed of at least two C-shaped or arcuate portions. Each of the C-shaped sections comprises first and second ends. Preferably, the first and second ends have different widths. The first and second ends are separated by an intermediate portion in which no two points along the cross-section of the wall corresponding to the intermediate portion share the same width.

Figure 3:
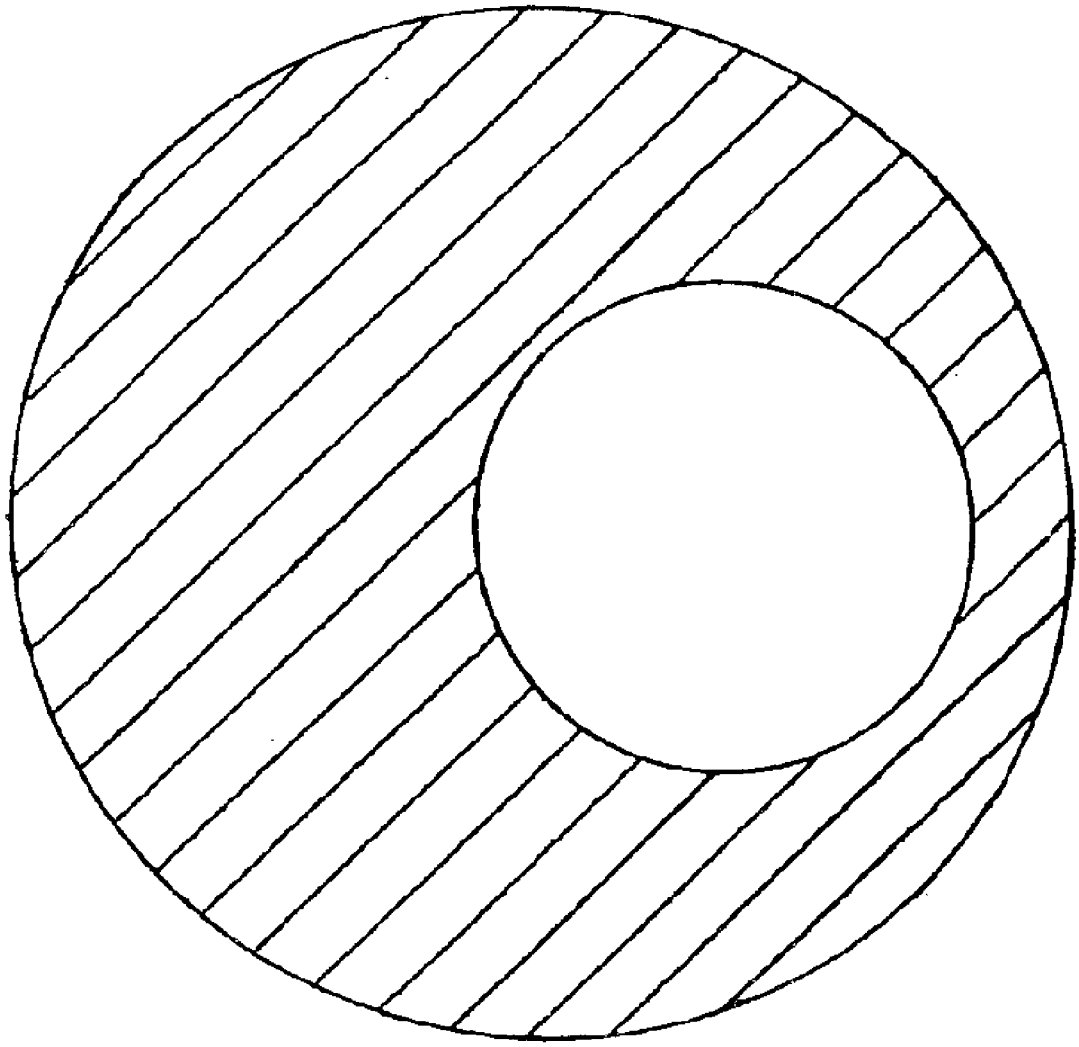
FIG. 3 is a schematic cross-section of a filament according to the invention.

The hollow polymer filament according to the invention also may be described in terms of its unique cross-section. Referring now to FIG. 3, the geometry of the two C-shaped portions creates a cylindrical wall in which the thickness of the wall graduates along its circumference.

Filaments formed according to the present invention, even though self-coiling and self-texturing, can also be mechanically or otherwise textured as described previously to give additional textured properties should such be desired or necessary. The invention is thus not limited to methods in which no mechanical or other texturing steps are carried out, but instead provides a method in which such other texturing methods can be minimized or eliminated if so desired, or included if so desired.

Furthermore, although the invention is described in the context of a recycling operation, the concepts utilized by the invention are equally applicable to manufacturing operations using virgin feedstock.

The invention has been described in detail, with reference to certain preferred embodiments, in order to enable the reader to practice the invention without undue experimentation. However, a person having ordinary skill in the art will readily recognize that many of the components and parameters may be varied or modified to a certain extent without departing from the scope and spirit of the invention. Furthermore, titles, headings, or the like are provided to enhance the reader's comprehension of this document, and should not be read as limiting the scope of the present invention. Accordingly, only the following claims and reasonable extensions and equivalents define the intellectual property rights to the invention thereof.

That which is claimed is:

1. A hollow polyester filament having a generally cylindrical cross-section, said filament comprising a cylindrical wall in which the thickness of the wall graduates along its entire circumference and in which one side of the hollow filament is more oriented than the other.

2. A hollow polymer filament according to claim 1 wherein the filament is coiled.

3. A cut staple fiber formed from the polyester filament of claim 1.

4. A polyester yarn formed from staple fibers according to claim 3.

5. A fabric comprising polyester yarn according to claim 4.

6. A woven fabric according to claim 5.

7. A knitted fabric according to claim 5.

8. A non-woven fabric comprising the filament of claim 1.

9. A cut staple fiber formed from the polyester filament of claim 1.

10. A polyester yarn formed from staple fibers according to claim 9.

11. A fabric comprising polyester yarn according to claim 10.

12. A woven fabric according to claim 11.

13. A knitted fabric according to claim 11.

14. A non-woven fabric comprising the filament of claim 1.

* * * * *